US010913525B1

(12) United States Patent
Parteko et al.

(10) Patent No.: US 10,913,525 B1
(45) Date of Patent: Feb. 9, 2021

(54) SYSTEMS FOR PROVIDING ACCESS WITHIN THE HELM OF A MARINE VESSEL

(71) Applicant: Brunswick Corporation, Mettawa, IL (US)

(72) Inventors: Rachel Parteko, Ossian, IN (US); Erin E. Foldesi, Fort Wayne, IN (US); Jacob M. Oswalt, Bluffton, IN (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 16/599,749

(22) Filed: Oct. 11, 2019

(51) Int. Cl.

| | |
|---|---|
| ***B63H 25/10*** | (2006.01) |
| ***B63H 25/00*** | (2006.01) |
| ***B63H 25/02*** | (2006.01) |
| ***B63B 49/00*** | (2006.01) |

(52) U.S. Cl.
CPC ..... *B63H 25/02* (2013.01); *B63B 49/00* (2013.01)

(58) Field of Classification Search
CPC .. B63H 25/00; B63H 25/02; B63H 2025/022; B63B 49/00
USPC ..... 114/144 R, 144 RE, 144 A
See application file for complete search history.

(56) References Cited

U.S. PATENT DOCUMENTS

| | | | | |
|---|---|---|---|---|
| 4,440,457 | A * | 4/1984 | Fogelman | A63F 13/08 463/46 |
| 7,194,974 | B2 * | 3/2007 | Kamio | B63H 25/02 114/144 R |
| 7,367,855 | B2 * | 5/2008 | Iwakami | B63H 25/10 248/73 |
| 9,937,983 | B1 | 4/2018 | Duke et al. | |
| 2002/0053310 | A1 * | 5/2002 | Ibata | B63B 19/14 114/55.53 |
| 2006/0037524 | A1 * | 2/2006 | Kamio | B63H 25/02 114/144 R |
| 2006/0137586 | A1 * | 6/2006 | Yoshiki | B63H 25/02 114/55.52 |
| 2019/0190324 | A1 * | 6/2019 | Bossetti | G01D 5/24 |
| 2020/0102057 | A1 * | 4/2020 | Bailey | G06F 3/011 |

* cited by examiner

*Primary Examiner* — Daniel V Venne
(74) *Attorney, Agent, or Firm* — Andrus Intellectual Property Law, LLP

(57) ABSTRACT

A helm for controlling a marine vessel with instruments and a steering device. The marine vessel has forward and aft ends defining a longitudinal center line therebetween. The helm includes a base that extends upwardly from a floor of the marine vessel to a top of the base. The base supports the steering device. A cover is pivotally coupled to the top of the base, where the cover is pivotable away from the longitudinal center line between an open position and a closed position. Wiring for the instruments is accessible from the top of the base only when the cover is in the open position.

13 Claims, 5 Drawing Sheets

SYSTEMS FOR PROVIDING ACCESS WITHIN THE HELM OF A MARINE VESSEL

FIELD

The present disclosure generally relates to systems for providing access within the helm of a marine vessel, and more particularly systems for providing access within the helm of a marine vessel including a pivotable cover.

BACKGROUND

The following U.S. Patents and Patent Applications provide background information and are incorporated by reference in entirety.

U.S. Pat. No. 9,937,983 discloses a pontoon boat including at least two pontoon tubes, a platform supported on the at least two pontoon tubes, and an occupancy compartment capable of containing at least one occupant, the occupancy compartment having a length, a width, an upper portion extending vertically above the platform that includes a ceiling, and a lower portion extending vertically below the platform and into one of the at least two pontoon tubes, the lower portion including a floor surface for supporting the occupant. An entrance to the occupancy compartment is provided in the upper portion that permits the occupant to enter and exit the occupancy compartment.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

One embodiment of the present disclosure generally relates to a helm for controlling a marine vessel with instruments and a steering device, the helm including a base that extends upwardly from a floor of the marine vessel to a top of the base. The base supports the steering device. A cover is pivotally coupled to the top of the base. The marine vessel has forward and aft ends defining a longitudinal center line therebetween. The cover is pivotable away from the longitudinal center line between an open position and a closed position. Wiring for the instruments is accessible from the top of the base only when the cover is in the open position.

Another embodiment generally relates to a helm for controlling a marine vessel with instruments and a steering device. The helm includes a base that extends upwardly from a floor of the marine vessel to a top of the base. The base supports the steering device. A cover is pivotally coupled to the top of the base. The marine vessel has forward and aft ends defining a longitudinal center line therebetween. The cover is pivotable away from the longitudinal center line about a pivot axis between an open position and a closed position. The instruments are supported by the cover and pivot therewith. A storage compartment defined within the cover rotates therewith, where a storage compartment door is removably coupled to the cover for accessing the storage compartment. The storage compartment door is removable away from the steering device. A biasing device assists in pivoting the cover from the closed position to the open position. The pivot axis is parallel to the longitudinal center line. The cover has inner and outer edges and the inner edge is closer than the outer edge to the longitudinal center line. The cover is pivotally coupled closer to the outer edge than to the inner edge. Wiring for the instruments is accessible from the top of the base only when the cover is in the open position.

Various other features, objects and advantages of the disclosure will be made apparent from the following description taken together with the drawings.

BRIEF DESCRIPTION OF THE DRAWINGS

The present disclosure is described with reference to the following Figures.

DETAILED DISCLOSURE

The part of a marine generally associated with steering and/or controlling the marine vessel is often referred to as the helm, which may include a steering device, throttle controller, instruments, and other equipment and features. Some marine vessels have multiple helms (e.g., for an upper level and a lower level), and each helm is generally configured for the needs of that particular type of marine vessel.

As the instruments and other equipment incorporated within a helm continue to expand in number and complexity, including various electronic devices (e.g., speedometers and tachometers, temperature gauges, depth gauges, fish finders, navigation equipment, wind sensors, sound systems, communication equipment, and/or the like), the present inventors have recognized that access for installing, servicing, and otherwise maintaining these components within the helm become further complicated as well. In many cases, access within the helm (such as to wires, cables, and/or the like) typically involves disassembly and/or removal of portions of the helm, reaching through narrow side panels within the helm, and/or lying on the floor of a marine vessel and reaching up into awkward spaces not particularly designed for subsequent access. Exemplary marine vessels include pontoon boats and runabouts. However, it should be recognized that the present disclosure is applicable for any type of boat having a helm.

Figure 1:
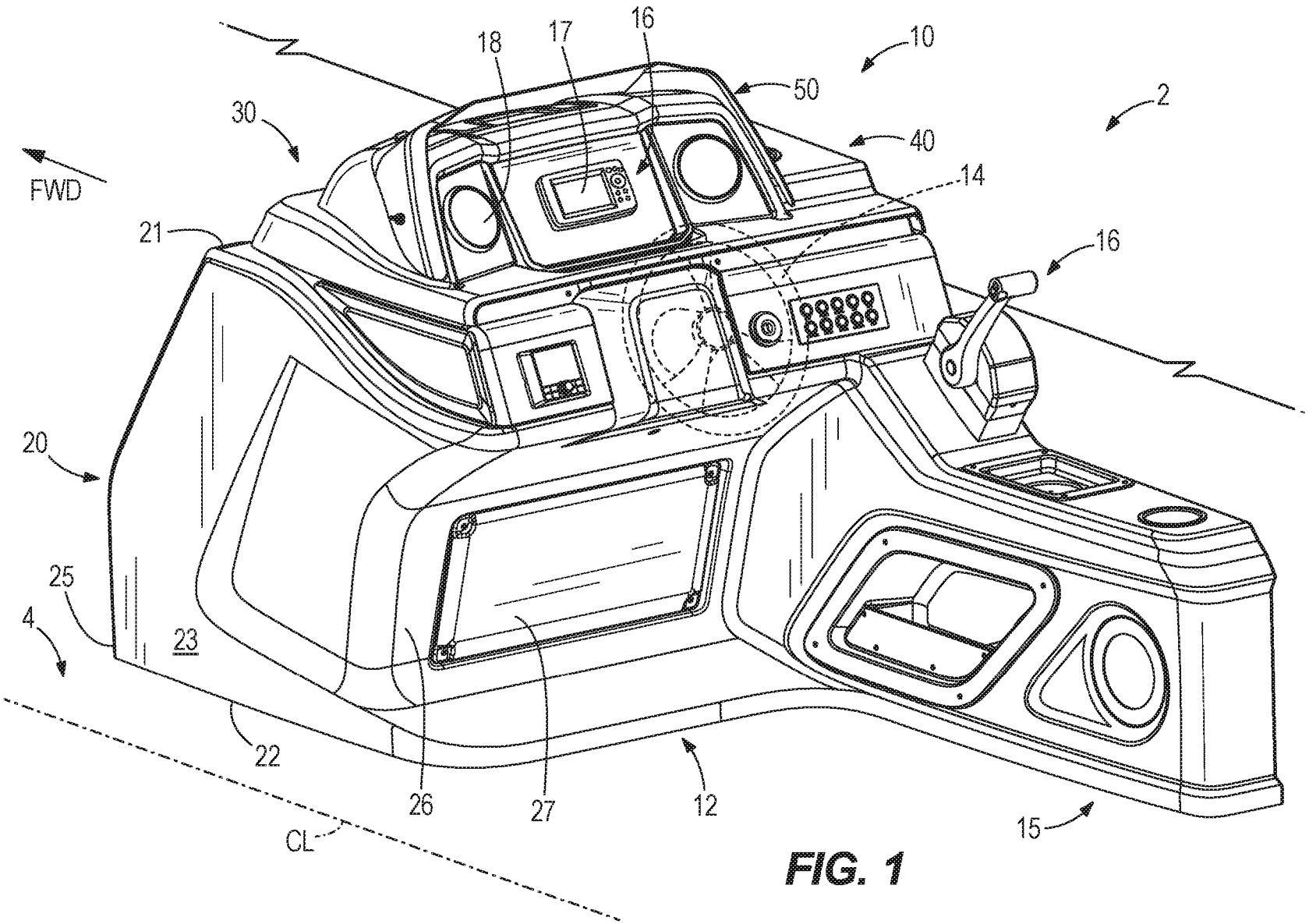
FIG. 1 is a rear isometric view of a helm of a marine vessel according to the present disclosure.

FIG. 1 depicts an exemplary helm 10 for controlling a marine vessel 2 according to the present disclosure. As shown, the helm 10 provides a basis for mounting instruments 16, such as a display 17 (e.g., for navigation and/or other equipment) and/or gauges 18, along with a steering device 14, throttle device 16, and other features necessary for controlling various functions of the marine vessel 2. The helm 10 generally includes a base 20 that extends upwardly from the floor 4 of the marine vessel 2 to a top 21 of the base 20.

Figure 2:
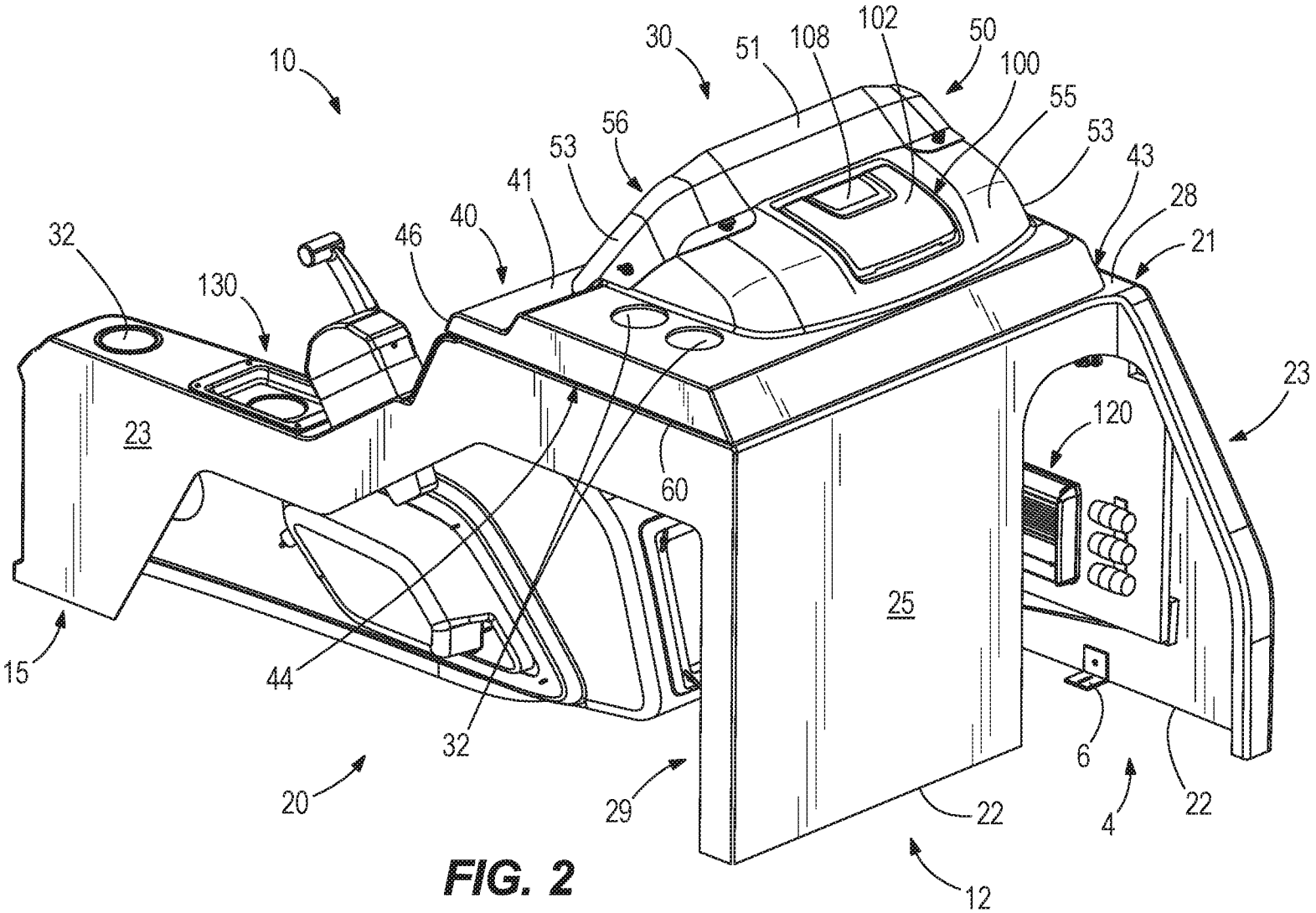
FIG. 2 is a front isometric view of the helm from FIG. 1 removed from the marine vessel.

As shown in FIGS. 1 and 2, the base 20 of the helm 10 generally includes a primary portion 12 and an extension 15. In the configuration shown, the primary portion 12 contains most of the instruments 16 and the steering device 14, and the extension 15 generally supports the throttle device 16. The primary portion 12 of the base 20 includes a front wall 25, aft wall 26, and sidewalls 23 that together to define a cavity 29 therein. In the example shown, an aft access panel 27 is provided on the aft wall 26 for access to a lower region of the cavity 29. However, as will be discussed below, access within the entire cavity 29 will also be provided via the top 21 of the base 20 when the cover 30 is in the open position.

Continuing with FIGS. 1 and 2, the cover 30 is pivotably coupled to the top 21 of the base 20, which provides easy access within the helm 10 as needed. As will be discussed further below, the helm 10 is configured such that wiring for the instruments 16 is accessible from the top 21 of the base 20 only when the cover 30 is in the open position (see FIG. 4). In this manner, any components or portions thereof within the cavity 29 are protected from the elements and also hidden from view. However, the present configuration provides that these hidden components are more readily accessible than with helms presently known to art, improving ergonomics and the time for performing installations, replacements, and service over systems and methods presently known.

The cover 30 is pivotally coupled to the base 20 via a hinge 60, which in the present embodiment is attached to a top mounting surface 28 (see FIG. 4) extending between the forward wall 25 and aft wall 26 of the base 20. The cover 30 includes a plateau portion 40 and an angled portion 50. The plateau portion 40 and angled portion 50 may be comprised of a single material, or may be subsequently coupled in a manner known the art. The plateau portion 40 generally has a top face 41, forward face 45, aft face 46, and side faces, particularly an inner edge 43 internal to the boat (nearest to a centerline CL running between a forward end FWD and an aft end of the marine vessel 2) and an outer edge 44 of the plateau portion 40, which in the embodiment shown is nearest to the outside of the boat. However, it should be recognized that the helm 10 may be mounted centrally within the marine vessel 2, and thus the inner edge 43 and outer edge 44 are merely exemplary descriptions.

The angled portion 50 generally has a top face 51, forward face 55, aft face 56, and side faces 53. As best shown in FIG. 2 a storage compartment 100 is further provided within the forward face 55 of the angled portion 50, which as discussed below provides a region for storing articles such as cellphones, car keys, wallets, flashlights. In certain embodiments, the storage compartment 100 is insulated, thereby service as a built-in cooler for cold beverages and the like. Likewise, the plateau portion 40 in the embodiment shown has cup holders 32 defined within the top face 41. In the embodiment shown, a wireless charging mat 130 is also provided for charging an operator's cellphone, for example, and is positioned within the extension 15 of the base 20 for convenience to the operator. In certain embodiments, the wireless charging mat 130 also defines a drain (not shown) such that fluid does not accumulate in the wireless charging mat 130. This is particularly advantageous where the wireless charging mat 130 is defined to be recessed within the extension 15 of the base 20 or elsewhere on the helm 10.

In the embodiment of FIG. 2, the base 20 is rigidly coupled to the floor 4 of the marine vessel. In particular, anchoring brackets 6 are used for mounting the helm 10 to the floor 4, which are hidden within the cavity 29 of the base 20. Likewise, it can be seen that various electronic components 120 may be positioned within the cavity 29 of the helm 10. As discussed above, the base 20 and cover 30 provide that these electronics components 120 are sheltered from the elements and generally protected from damage.

Figure 3:
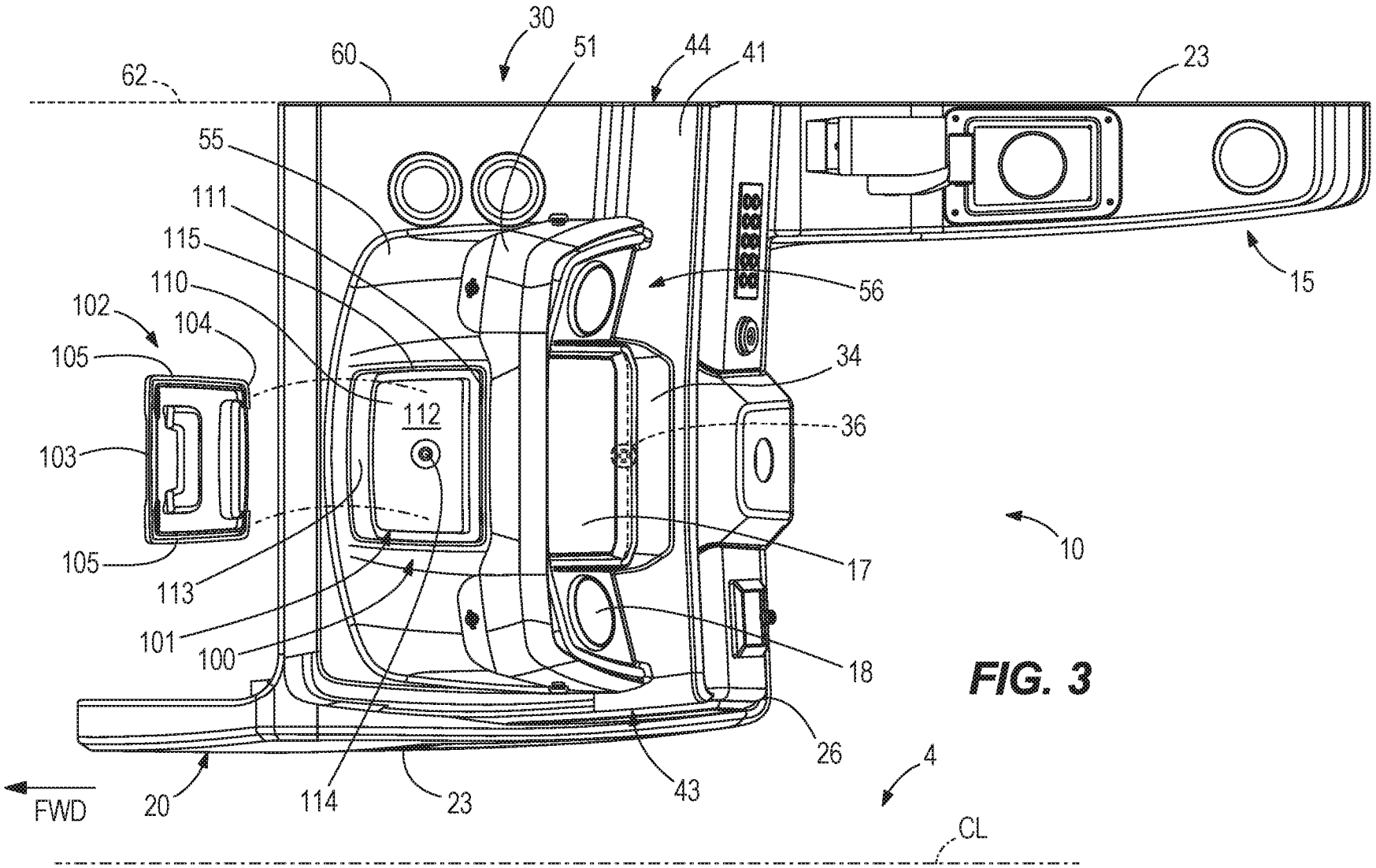
FIG. 3 is a top view of the helm from FIG. 1 with the door of a storage compartment removed.

FIG. 3 further depicts the storage compartment 100 previously described, which is defined within the front face 55 of the angled portion 50 of the cover 30. In the embodiment shown, the storage compartment 100 is insulated and designed to store items meant to remain cold, such as beverages along with an ice pack. The cavity 110 of the storage compartment 100 is accessible via an opening 101. The opening 101 is particularly defined between an upper edge 111, lower edge 113, and side edges 115. A door 102 having a handle 108 (see FIG. 2) correspondingly has an upper edge 103, lower edge 104, and side edges 105 such that the door 102 is removable coupled within the opening 101 via a press-fit configuration. It should be recognized that other configurations are also anticipated, such as a hinged connection between the lower edge 113 of the opening 101 and the lower edge 104 of the door 102, for example.

The cavity 110 for storing articles further including a drain port 114 defined in the bottom 112 for permitting liquid (such as condensation from cold beverages) to exit the cavity 110. As will be discussed further below, the drain port 114 is further connected to a conduit 116 (FIG. 4) to direct the fluid draining via the drain port 114 to a location safe to get wet. Exemplary locations just above the floor 4 within the base 20, outside of the base 20, or into a bilge sump below the floor 4. This ensures that the fluid exiting the drain port 114 does not drip on the electronic components 120 within the base 20, causing damage.

A similar drainage system is also provided within the top face 41 of the plateau portion 40, such as for draining water from rough seas or rain from the cover 30. In the embodiment shown, a drain gutter 34 is defined within the top face 41 of the plateau portion 40, which drains fluid down to a drain port 36. As will be discussed further below, the drain port 36 is connected to a conduit 38 in a similar manner to that previously described for the drain port 114 of the storage compartment 100, once again to control where the fluid is ultimately dispensed.

Figure 4:
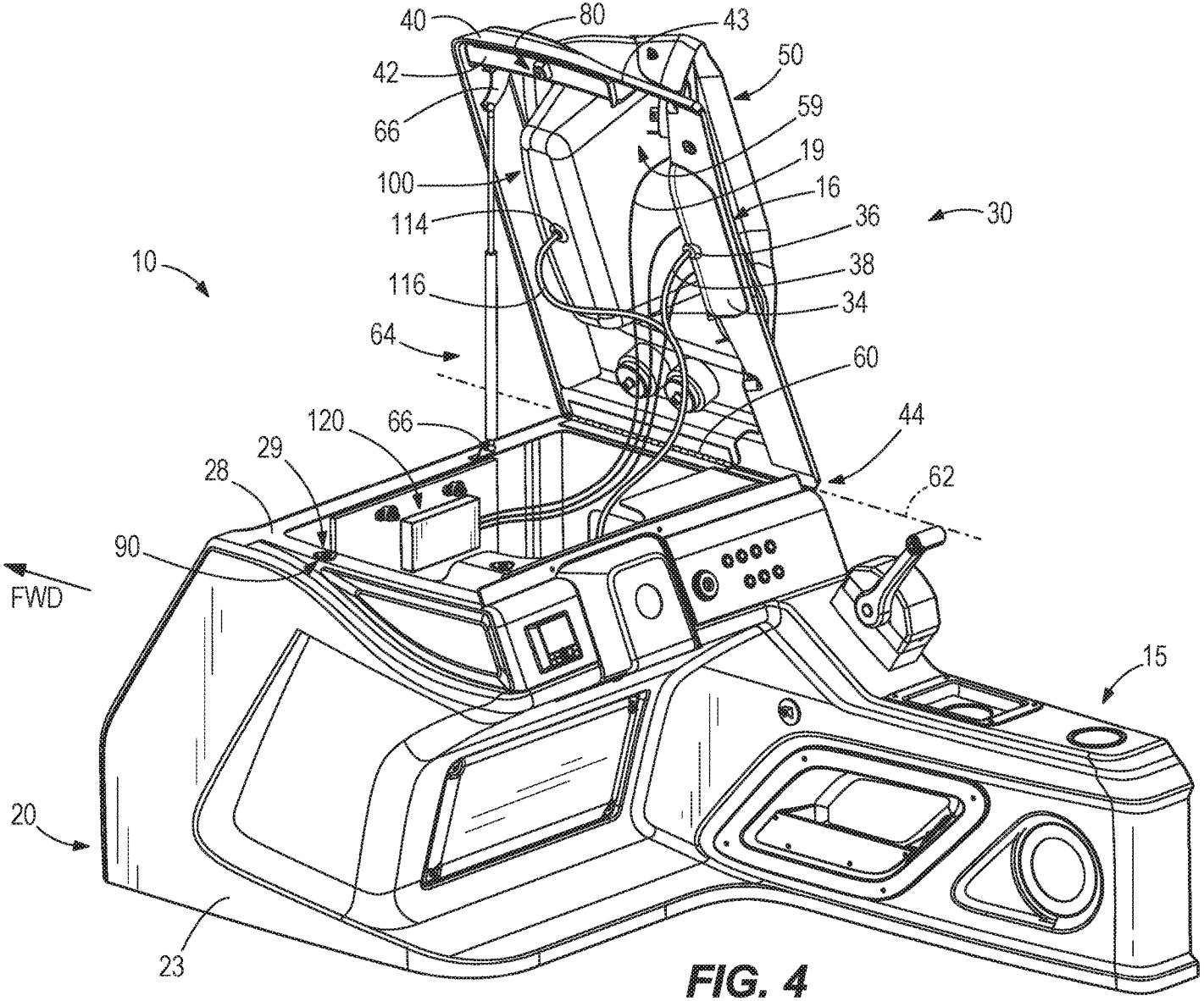
FIG. 4 depicts the helm of FIG. 1 with the cover shown in an open position.

FIG. 4 depicts the helm 10 of FIG. 1 with cover 30 in an open position, in contrast to the fully-closed positions shown in FIGS. 1-3. As previously discussed, the cover 30 is coupled at the outer edge 44 of the plateau portion 40 to a hinge 60 by a method presently known in the art, such as bolts and nuts, for example. The hinge 60 is also coupled to the top mounting surface 28 at the top 21 of the base 20. In certain embodiments, the hinge 60 is a piano-type hinge made of stainless steel to prevent rusting and corrosion. The hinge 60 is pivotable about the pivot access 62 such that the cover 30 swings open towards the outside of the marine vessel 2, providing access to the content within the cavity 29 of the base 20.

In the embodiment shown in FIG. 4, a biasing device 64, shown here as a gas cylinder, is coupled via anchoring brackets 66 to the top mounting surface 28 of the base 20, as well as to the bottom face 42 of the plateau portion 40 of the cover 30. The biasing device 64 assists the operator in the opening of the cover 30 by lifting a portion of the weight thereof. The biasing device 64 also retains the cover 30 in the open position until the operator overcomes the biasing device 64 to once again close the cover 30. It should be recognized that other types of biasing devices 64 are also anticipated, such as springs, which may also or alternatively be incorporated within the hinge 60. Furthermore, certain embodiments include a biasing device 64 that does not assist in the opening of the cover 30, but only retains the cover 30 in the open position, such as a locking hinge in addition to, or used as the hinge 60.

In this manner, the presently disclosed helm 10 provides easy and ergonomic access to the cavity 29 of the base 20 from inside the marine vessel, and without the need to physically remove the cover 30 or any hardware associated therewith. Additionally, the instruments 16 provided with the cover 30 pivot therewith, providing access to the wiring 19 and other connections associated with these instruments 16 as needed.

The present inventors have further identified a further advantage by pivoting the cover 30 to the side, namely that this avoids rubbing, friction, and/or compression of furniture positioned forward of the helm 10. Likewise, pivoting the cover 30 to the side improves the ergonomics of access for the operator, allowing them to the stand on the floor 4 next to the helm 10 rather than reaching over furniture and/or the like. However, the present inventors encountered particular challenges in designing a helm 10 in which the cover 30 pivots to the side. For example, it is common for a cover 10 to have a greater width (port to starboard) than length (forward to aft). Therefore, it is more difficult to pivot (and retain) a cover 30 to the side, as this requires overcoming a greater moment arm about the pivot axis. Likewise, this requires reconstruction of the cover 30 to particularly accommodate these forces, or in other words to withstand its own weight.

As previously described, the conduit 116 and the drain port 114 for the storage compartment 100, as well as the conduit 38 for the drain port 36 of the cover 30 are also shown in FIG. 4. In the embodiment shown, the conduit 116 and conduit 38 merge, such as with a Y-coupler (not shown) and are ultimately discharged onto the floor 4 of the marine vessel 2. This ensures that none of the electronic components 120 within the base 20 come into contact with the drained fluid. In certain embodiments, the conduit 116, conduit 38, and wiring 19 are coupled to the cover 30 and/or the top 21 of the base 20 in positions near the hinge 60 such that no pushing or pulling occurs when the cover 30 is pivoted between the open and closed positions.

It should be recognized that while the cover 30 in the present embodiment is shown to be pivoting towards the outside of the marine vessel 2, other embodiments are also anticipated. For example, the cover 30 may alternatively pivot along the forward wall 25 of the base 20 and the forward face 45 of the plateau portion 40 of the cover 30 such that the cover 30 pivots away from the steering device 14. However, another advantage of configuring the cover 30 to open to the outside is that any water, dirt, or other debris thereon is directed out of the marine vessel 2, rather than onto the floor 4 or the operator's chair at the helm 10.

Figure 5:
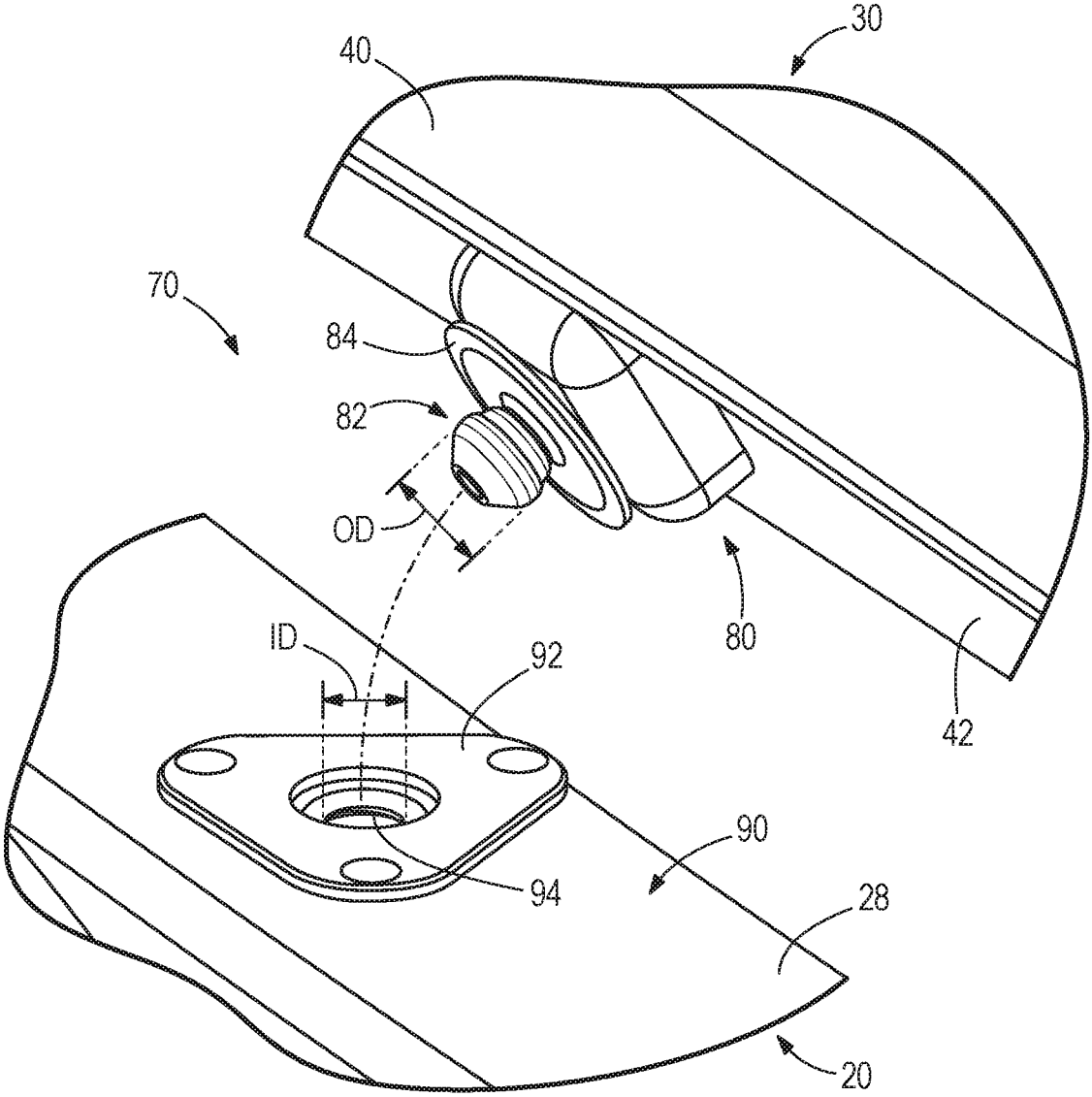
FIG. 5 depicts an exemplary locking feature for retaining the cover of the helm in a closed position such as shown in FIG. 1.

FIG. 5 depicts an exemplary locking feature 70 for removably retaining the cover 30 in the closed position. In the embodiment shown, the locking feature 70 includes a male end 80 and a female end 90, such as would be readily available in the market as product number. The male end 80 has a catching tip 82 with a catch diameter OD that is received within a catching recess 94 having an inner diameter ID of the female end 90. The male end 80 is coupled to the bottom face 42 of the plateau portion 40 of the cover 30 via a base 84, and the female end 90 is coupled via a mounting portion 92 to the top mounting surface 28 of the base 20. An exemplary locking feature 70 available in the market is FastMount model no. LP-SM8As. In certain embodiments, a keyed lock (in certain cases matching the ignition key) is provided in addition to, or in the alternative to, the locking feature 70. This prevents unauthorized access to the cavity 29, such as to prevent theft for expensive instruments 16.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A helm for controlling a marine vessel with instruments and a steering device, the helm comprising:

a base that extends upwardly from a floor of the marine vessel to a top of the base, wherein the base supports the steering device;

a cover pivotally coupled to the top of the base, wherein the marine vessel has forward and aft ends defining a longitudinal center line therebetween, and wherein the cover is pivotable away from the longitudinal center line between an open position and a closed position;

a storage compartment defined within the cover that rotates therewith, wherein a storage compartment door is removably coupled to the cover for accessing the storage compartment; and wherein wiring for the instruments is accessible from the top of the base only when the cover is in the open position.

2. The helm according to claim 1, wherein at least one of the instruments is supported by the cover and pivots therewith.

3. The helm according to claim 2, wherein the at least one of the instruments supported by the cover and pivoting therewith comprises a display.

4. The helm according to claim 1, further comprising a biasing device that prevents the cover from pivoting from the open position to the closed position.

5. The helm according to claim 4, wherein the biasing device is further configured to assist in pivoting the cover from the closed position to the open position.

6. The helm according to claim 5, wherein the biasing device is a gas spring.

7. The helm according to claim 1, wherein a cavity is defined within the base, wherein additional electronic components are mounted within the cavity, and wherein the additional electronic components are accessible from the top of the base only when the cover is in the open position.

8. The helm according to claim 1, further comprising a wireless charging mat configured to charge a wireless device positioned in close proximity thereto.

9. The helm according to claim 1, wherein the storage compartment door is removably coupled to the cover via press fit.

10. The helm according to claim 9, wherein the storage compartment door is removable away from the steering device.

11. The helm according to claim 1, wherein the storage compartment defines a drain port for draining liquid therefrom, further comprising a conduit fluidly coupled to the drain port that communicates the liquid from the storage compartment to the floor of the marine vessel.

12. The helm according to claim 1, further comprising locking features releasably engageable between the base and the helm for retaining the cover in the closed position.

13. A helm for controlling a marine vessel with instruments and a steering device, the helm comprising:

a base that extends upwardly from a floor of the marine vessel to a top of the base, wherein the base supports the steering device;

a cover pivotally coupled to the top of the base, wherein the marine vessel has forward and aft ends defining a longitudinal center line therebetween, and wherein the cover is pivotable away from the longitudinal center line about a pivot axis between an open position and a closed position, wherein the instruments are supported by the cover and pivot therewith;

a storage compartment defined within the cover that rotates therewith, wherein a storage compartment door is removably coupled to the cover for accessing the storage compartment, and wherein the storage compartment door is removable away from the steering device; and a biasing device that assists in pivoting the cover from the closed position to the open position;

wherein the cover has inner and outer edges and the inner edge is closer than the outer edge to the longitudinal center line, and wherein the cover is pivotally coupled closer to the outer edge than to the inner edge; and wherein wiring for the instruments is accessible from the top of the base only when the cover is in the open position.

* * * * *